United States Patent [19]

Beare

[11] Patent Number: 4,888,932

[45] Date of Patent: Dec. 26, 1989

[54] METHOD OF MOUNTING OF TILES AT THE HIP OF A ROOF

[76] Inventor: Winston Beare, 40 Epping Street, Kyneton, Victoria, 3444, Australia

[21] Appl. No.: 355,703

[22] Filed: May 23, 1989

[51] Int. Cl.[4] ..... F04B 7/02

[52] U.S. Cl. ..... 52/748; 52/276

[58] Field of Search ..... 52/275, 276, 278, 279, 52/277, 13, 748

[56] References Cited

U.S. PATENT DOCUMENTS

| | | | |
|---|---|---|---|
| 594,139 | 11/1897 | Knowlton | 52/276 |
| 1,269,583 | 6/1918 | Davis | 52/276 |
| 2,718,673 | 9/1955 | Nelsson | 52/276 |
| 3,707,821 | 1/1973 | Leddy | 52/748 |
| 4,601,135 | 7/1986 | Ellis | 52/748 X |

FOREIGN PATENT DOCUMENTS

| | | | |
|---|---|---|---|
| 466394 | 9/1928 | Austria | 52/13 |

*Primary Examiner*—John E. Murtagh

*Attorney, Agent, or Firm*—Sughrue, Mion, Zinn, Macpeak & Seas

[57] ABSTRACT

The construction of a hip at the bottom corner of a tiled roof includes a tray which supports the roofing tiles cut into the hip at the point. The tray has, at its bottom edge flanges against which the tiles rest in order to provide positive support for these tiles.

4 Claims, 4 Drawing Sheets

METHOD OF MOUNTING OF TILES AT THE HIP OF A ROOF

FIELD OF THE INVENTION

The present invention relates to an improved method of mounting tiles on the hip of a roof in order to prevent slippage and subsequent penetration of rain, snow or wind into the roof at the hip.

BACKGROUND OF THE INVENTION

Hip tiles are located on a roof at the junction between two differently inclined planes of the roof in order to span the adjacent roofing tiles on the two planes and thus cover the gap in that zone. In a typical roof, the hip will extend from the bottom of the roof at one corner to the ridge of the roof. Conventionally, the roofing tiles immediately adjacent the hip are cut or mitred so as to fit at the hip, with the two mitred tiles at the bottom corner overhanging, and resting on, the fascia boards at the edge of the roof. The hip tiles which span the gap between the mitred roofing tiles are secured at the hip by mortar placed between the hip tiles and the adjacent roofing tiles. On a new roof, the fascia boards tend to warp after a year or so which causes movement of the corner roof tiles and hence movement of the lowermost hip tile. The lowermost hip tile may slip down resulting in exposure of the gap in the hip at that point and penetration of rain and snow into the roof.

An object of the invention is to solve the problem outlined above, by providing means for firmly holding the roofing tiles at the bottom corner against movement.

SUMMARY OF THE INVENTION

According to the invention, there is provided a method of forming a hip joint at the bottom corner of a hip defined between two roof sections facing in different directions, said method comprising the steps of providing a tray having body portions each of which lies in the plane of a respective one of the two roof sections, with each body portion having means for positively supporting an adjacent corner tile of the roof section, fastening the tray to the structure of the roof with the tray lying in the zone of the bottom corner of the hip, applying roofing tiles to the roof with the two corner tiles at the bottom corner being supported on the respective body portions of the tray and retained by the supporting means of the tray against downwards movement, and securing hip tiles over the roofing tiles.

BRIEF DESCRIPTION OF THE DRAWINGS

The invention will now be described, by way of example only, with reference to the accompanying drawings, in which.

DESCRIPTION OF THE PREFERRED EMBODIMENT

Figure 1:
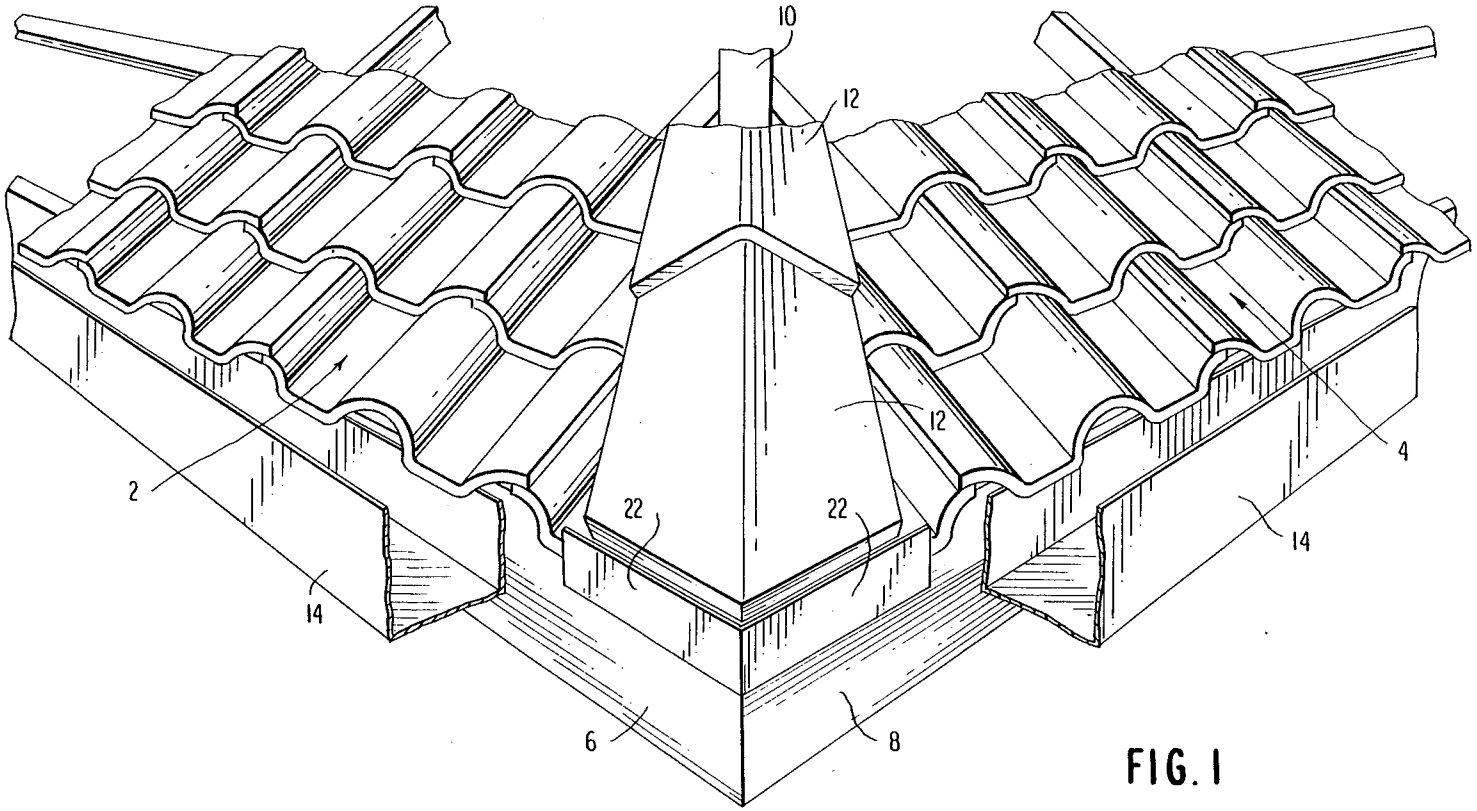
FIG. 1 is a perspective view showing part of a roof with a completed hip construction.

FIG. 1 shows a roof construction at the bottom corner in the zone of the hip. The hip is defined at the line of intersection of two planar sections 2, 4 of the roof which face in different directions. Normally, the two sections 2, 4 of the roof face in mutually perpendicular directions. Fascia boards 6, 8 at the bottom of each roof section 2, 4 meet at the corner and a hip beam 10 extends upwardly from the corner to the ridge of the roof. Hip tiles 12 extend upwardly along the hip to cover the gap between the adjacent roofing tiles which are cut or mitred in order to fit into the hip. The fascia boards carry guttering 14 schematically shown in the drawings.

Figure 2:
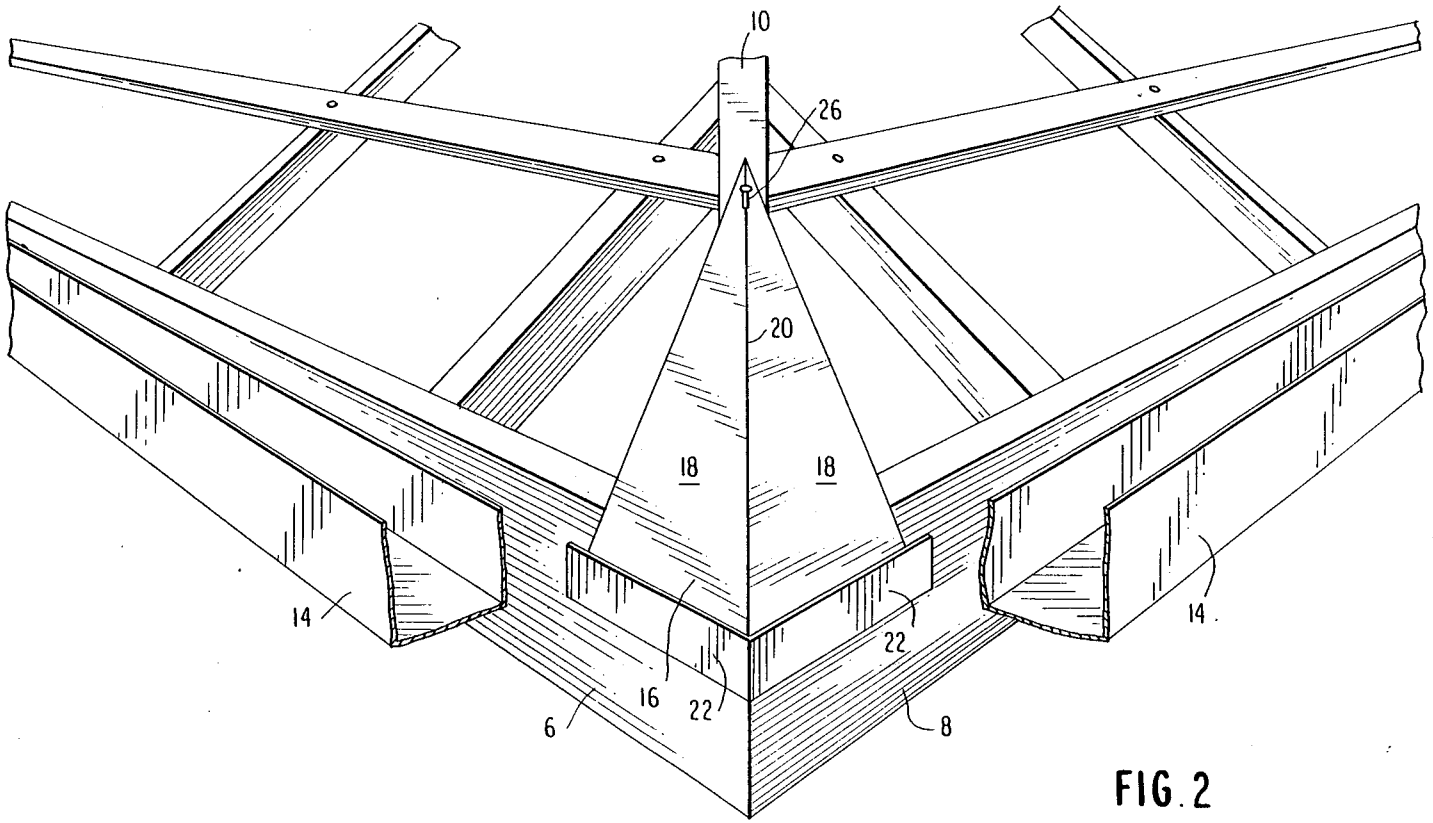
FIGS. 2 and 3 s successive stages in the construction of the hip.
Figure 4:
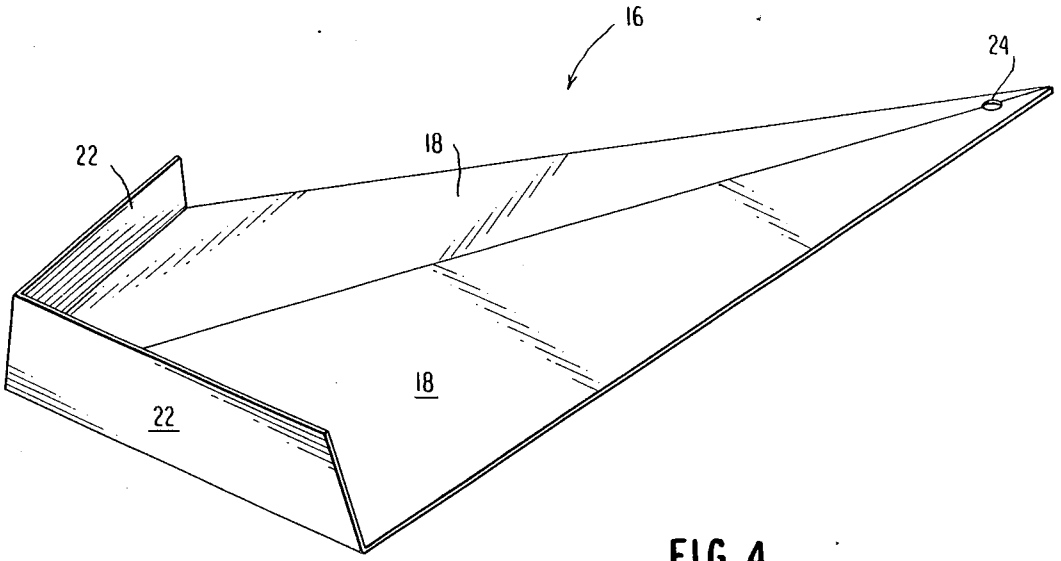
FIG. 4 is a perspective view of a tray used in the construction of the bottom corner of the hip.

In accordance with the invention, the two mitred roof tiles at the bottom corner of the roof are supported by means of a tray 16 which provides positive location for the roof tiles at that point and which also seals the roof in that zone. The tray 16 is shown in FIGS. 2 and 4 and comprises a triangular body defined by two inclined planar portions 18 which meet at a central apex 20. The two planar portions 18 are relatively inclined one to the other at an angle which corresponds to the angle of intersection of the two planar sections 2, 4 of the roof so that each of the planar portions 18 of the triangular body is able to lie in the plane of the associated roof section when the apex 20 of the tray is aligned with the hip on the roof. The bottom edge of the tray consists of an upstanding flange defined by two flange sections 22 one at right angles to the other. Each flange section 22 is associated with one of the inclined portions 18 of the triangular body so as to extend in a direction parallel to the bottom edge of the corresponding roof section. Towards its upper end, the tray is provided with a hole 24 for receiving a nail 26 by which the tray can be firmly secured to the hip beam 10. The tray is preferably pressed from sheet metal galvanised or otherwise resistant to corrosion.

Figure 3:
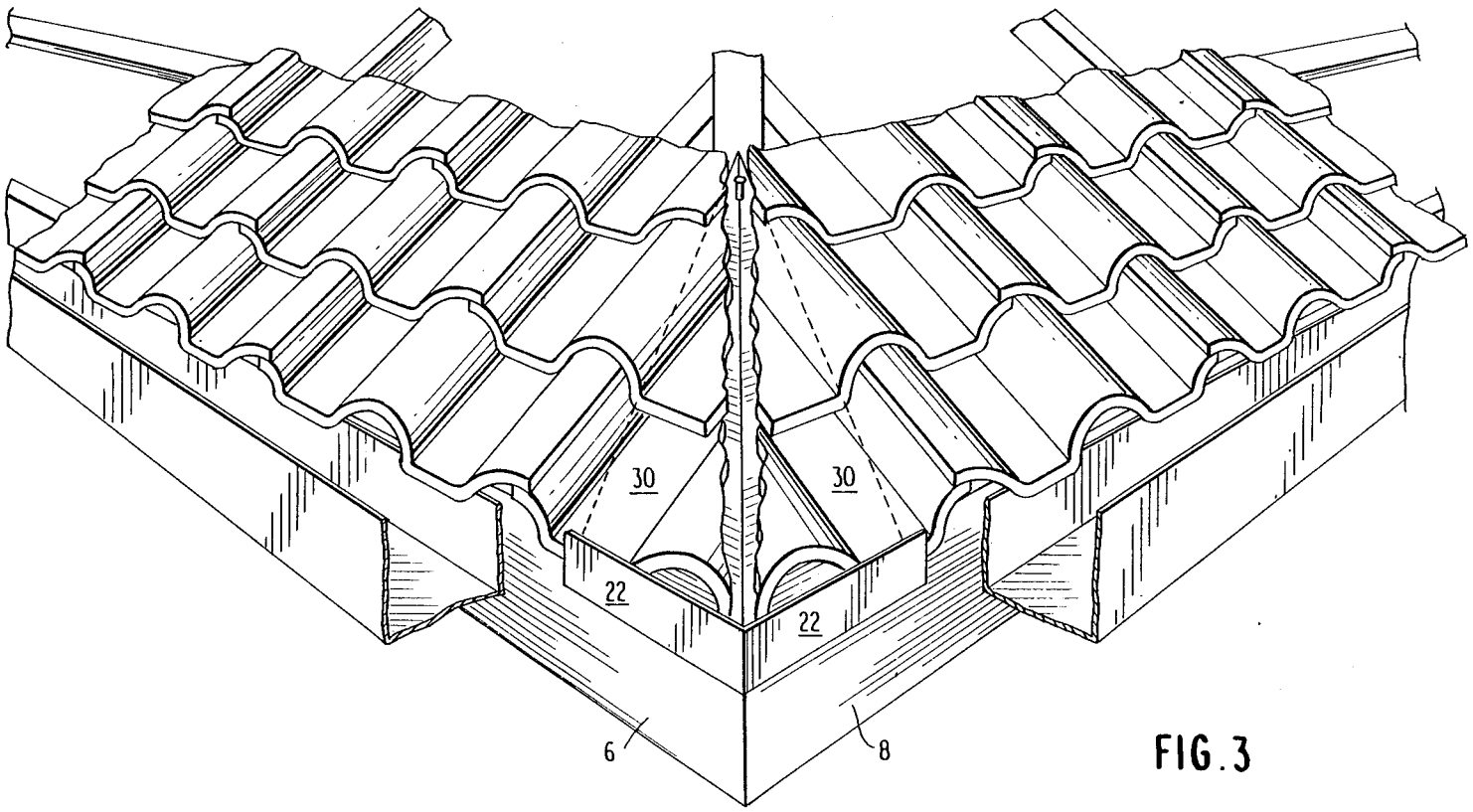

As shown in FIG. 2, the lower corner of the roof, after erection of the appropriate supporting beams and fascia boards, is constructed by nailing the tray 16 to the hip beam 10 in such a position that the flanges 22 at the bottom edge of the tray will coincide with the bottom corner of the hip. After mounting the lowermost row of roofing tiles on the two adjacent sections 2, 4 of the roof, the two corner roofing tiles are cut or mitred so as to fit into the bottom corner of the roof. These corner tiles are clearly shown in FIG. 3 and designated 30. When located in position, the corner tiles 30 will rest on the two inclined body portions 18 of the tray 16 with their bottom edges engaging the inner sides of the upstanding flange sections 22 which have the effect of ensuring that the corner tiles 30 not slip. After completion of the tiling in the zone of the hip, the hip tiles 12 are placed over the hip in that zone and are mortared in position.

The tray 16 supports in a positive manner the corner tiles 30 against slipping even after movement of the facia boards through warping. Accordingly, the lowermost hip tile is prevented from slipping. The tray will also act to provide an effective weatherproof seal against penetration of water at that point. Apart from providing positive support for the corner tiles in the finished roof, the positive support provided by the tray for these tiles during erection means that the roof tiler does not have to hold these tiles in position whilst applying the hip tiles and the mortar for the hip tiles.

Modifications are possible within the scope and spirit of the appended claims.

I claim:

1. In the construction of a tiled roof, a method of forming a hip joint at the bottom corner of a hip defined between two roof sections facing in different directions, said method comprising the steps of providing a tray having body portions each of which lies in the plane of a respective one of the two roof sections, with each body portion having means for positively supporting an adjacent corner tile of the roof section, fastening the tray to the structure of the roof with the tray lying in the zone of the bottom corner of the hip, applying roofing tiles to the roof with the two corner tiles at the bottom corner being supported on the respective body portions of the tray and retained by the supporting means of the tray against downwards movement, and securing hip tiles over the roofing tiles.

2. A method according to claim 1, wherein the supporting means comprise an upstanding flange portion associated with each respective body portion at a lower edge of the tray, each respective flange portion being substantially perpendicular to the body portion and the two flange portions being mutually inclined at right angles.

3. A method according to claim 1, wherein the step of fastening the tray to the roof structure comprises the step of nailing the tray to a hip beam by means of a nail passing through an aperture arranged substantially on the longitudinal centre line of the tray.

4. A method according to claim 2, wherein the tray is formed from sheet metal with the main body portion of the tray being substantially triangular in shape.

* * * * *